US005306217A

United States Patent [19]

Bracone

[11] Patent Number: 5,306,217

[45] Date of Patent: Apr. 26, 1994

[54] SWIMMING POOL BALLET BAR

[76] Inventor: Monica G. Bracone, 4823 Lansing St. NE, St. Petersburg, Fla. 33703

[21] Appl. No.: 12,774

[22] Filed: Feb. 3, 1993

[51] Int. Cl.[5] ..... A63B 31/00

[52] U.S. Cl. ..... 482/55; 482/908; 4/496; 4/577.1

[58] Field of Search ..... 482/55, 148, 908; 434/254; 4/494, 496, 504, 576.1, 577.1; 403/348, 349, 350; D25/41; D21/237

[56] References Cited

U.S. PATENT DOCUMENTS

| | | | |
|---|---|---|---|
| 2,317,729 | 4/1943 | Bruno | 403/348 |
| 3,228,038 | 1/1966 | Augustine | 4/576.1 |
| 3,568,220 | 3/1971 | Dees | 4/576.1 |
| 3,724,012 | 4/1973 | Sanderson | 482/55 |
| 4,619,549 | 10/1986 | Gilbreth | 403/349 |
| 4,705,423 | 11/1987 | Smith | 403/350 |
| 4,875,673 | 10/1989 | Erickson | 482/55 |
| 4,941,659 | 7/1990 | Silvestri | 4/496 |

*Primary Examiner*—Richard J. Apley
*Assistant Examiner*—Jeanne M. Mollo
*Attorney, Agent, or Firm*—Leon Gilden

[57] ABSTRACT

A bar structure having support legs is arranged to include a mounting bracket mounted to each free distal end of each support leg pivotally mounting the bar relative to a deck surface of a swimming pool to permit positioning of the bar within the swimming pool for use as an exercise bar structure.

1 Claim, 4 Drawing Sheets

SWIMMING POOL BALLET BAR

BACKGROUND OF THE INVENTION

1. Field of the Invention

The field of invention relates to swimming pool apparatus, and more particularly pertains to a new and improved swimming pool ballet bar wherein the same is arranged for the pivoting within a swimming pool for access of an individual in an exercise procedure.

2. Description of the Prior Art

Exercise apparatus relative to a swimming pool structure is indicated in the U.S. Pat. Nos. 4,838,545; 4,875,673; 4,552,540; 4,948,118; and 4,822,031.

The instant invention is arranged to overcome deficiencies of the prior art by providing for a swimming pool exercise organization wherein the same is arranged for ease of mounting and rotative orientation of the exercise bar structure relative to the swimming pool and in this respect, the present invention substantially fulfills this need.

SUMMARY OF THE INVENTION

In view of the foregoing disadvantage inherent in the known types of swimming pool exercise apparatus now present in the prior art, the present invention provides a swimming pool ballet bar wherein the same is arranged for positioning within a swimming pool to provide for stability in an exercise procedure of an individual. As such, the general purpose of the present invention, which will be described subsequently in greater detail, is to provide a new and improved swimming pool ballet bar which has all the advantages of the prior art swimming pool exercise apparatus and none of the disadvantages.

To attain this, the present invention provides a bar structure having support legs, to include a mounting bracket mounted to each free distal end of each support leg pivotally mounting the bar relative to a deck surface of a swimming pool to permit positioning of the bar within the swimming pool for use as an exercise bar structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the present invention is to provide a new and improved swimming pool ballet bar which has all the advantages of the prior art swimming pool exercise apparatus and none of the disadvantages.

It is another object of the present invention to provide a new and improved swimming pool ballet bar which may be easily and efficiently manufactured and marketed.

It is a further object of the present invention to provide a new and improved swimming pool ballet bar which is of a durable and reliable construction.

An even further object of the present invention is to provide a new and improved swimming pool ballet bar which is susceptible of a low cost of manufacture with regard to both materials and labor, and which accordingly is then susceptible of low prices of sale to the consuming public, thereby making such swimming pool ballet bars economically available to the buying public.

Still yet another object of the present invention is to provide a new and improved swimming pool ballet bar which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
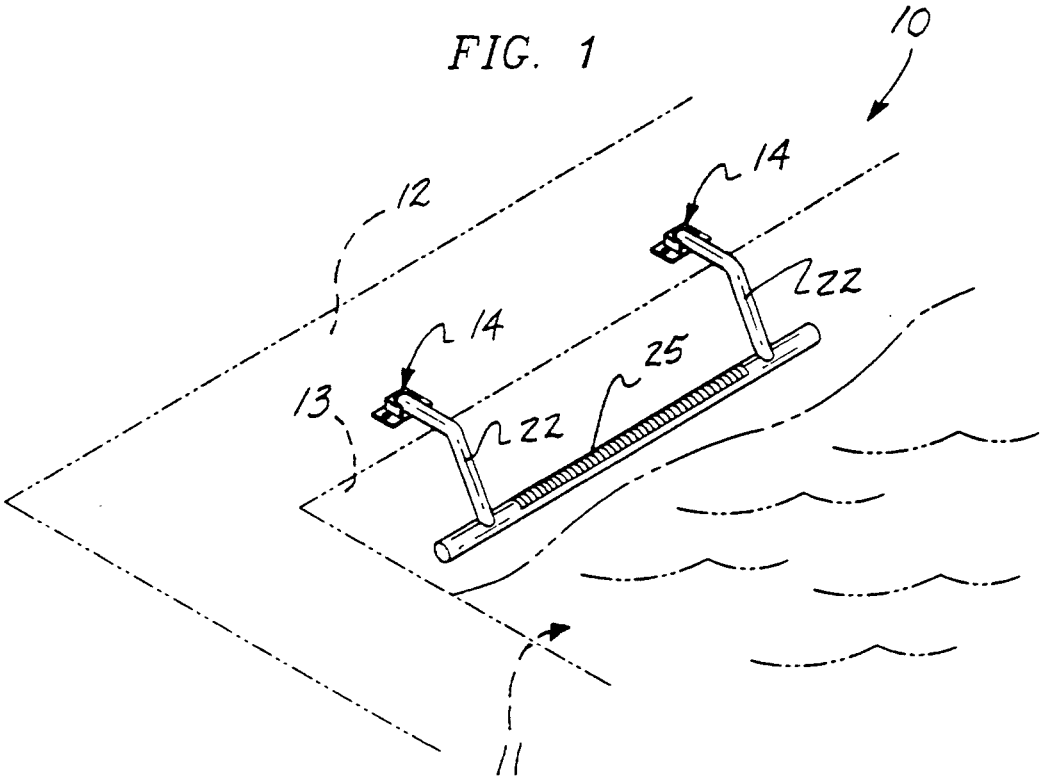
FIG. 1 is an isometric illustration of the invention mounted within a swimming pool structure.
Figure 2:
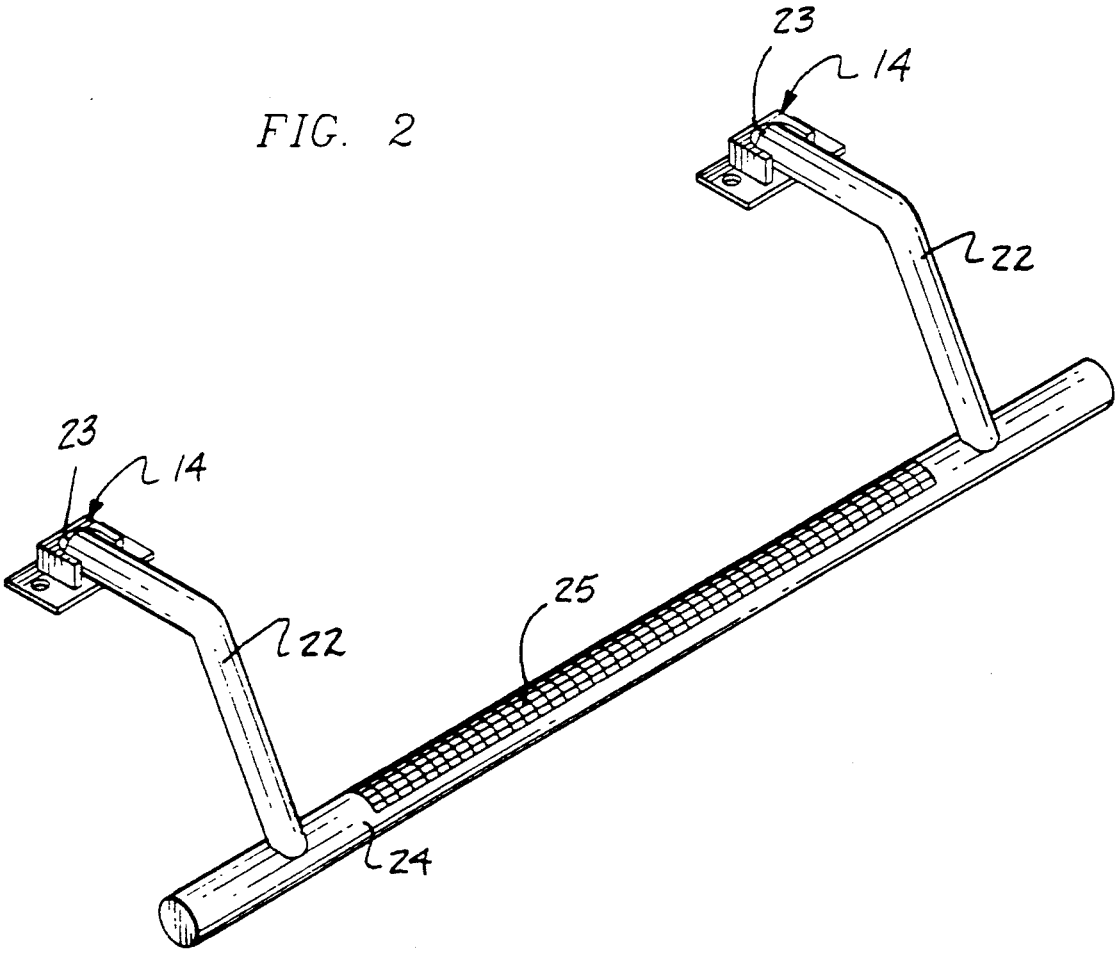
FIG. 2 is an enlarged isometric illustration of the invention.
Figure 3:
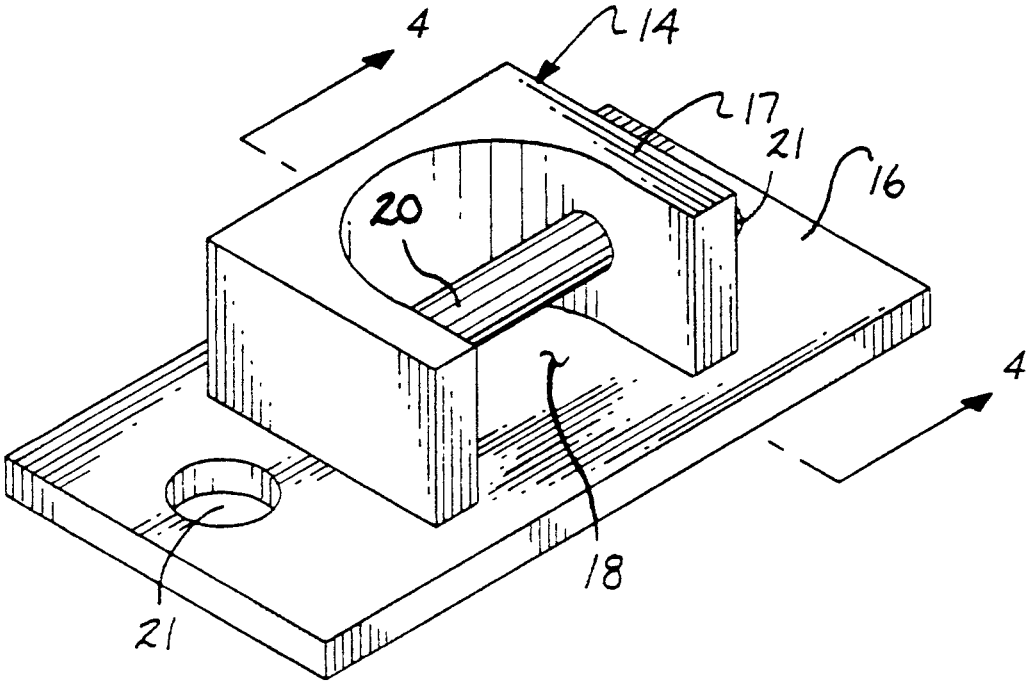
FIG. 3 is an enlarged isometric illustration of a support bracket structure of the invention.
Figure 4:
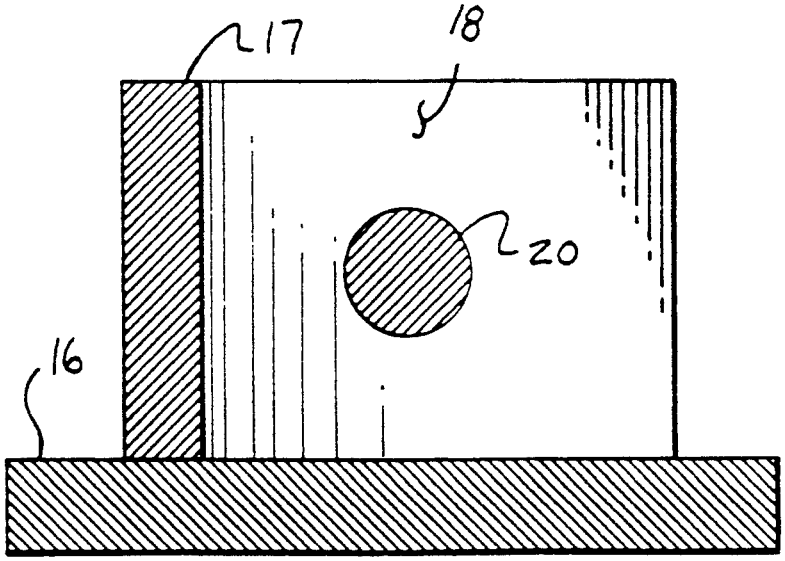
FIG. 4 is an orthographic view, taken along the lines 4—4 of FIG. 3 in the direction indicated by the arrows.

With reference now to the drawings, and in particular to FIGS. 1 to 8 thereof, a new and improved swimming pool ballet bar embodying the principles and concepts of the present invention and generally designated by the reference numeral 10 will be described.

More specifically, the swimming pool ballet bar 10 of the instant invention essentially comprises the mounting of the organization within a swimming pool 11, and more specifically, to the top wall deck 12 relative to a side wall 13 of the swimming pool to permit positioning of the ballet bar structure within the swimming pool 11 as indicated in FIG. 1.

The organization includes a plurality of spaced anchor brackets 14 of identical construction, each having a base plate 16 having a mounting aperture 21 on each side of a fixedly mounting a U-shaped support boss 17 to a top surface of the base plate 16, with the U-shaped support boss 17 having a boss receiving cavity 18. Within each cavity 18 of each boss 17 there is received a first end 23 of the support leg 22. A mounting bar 20 is mounted within each cavity 18 directed through a respective support leg 22 in adjacency to the support leg first end 23 to permit pivoting of each support leg 22 about its first end 23. Each support leg 22 is of an angular configuration having an exercise bar 24 orthogonally and fixedly mounted between the support leg 22, with the exercise bar having a roughened textured surface 25 extending between the support leg 22, as indicated. In this manner, pivoting of the exercise bar 24 is readily accommodated for manual grasping within the swimming pool structure.

Figure 5:
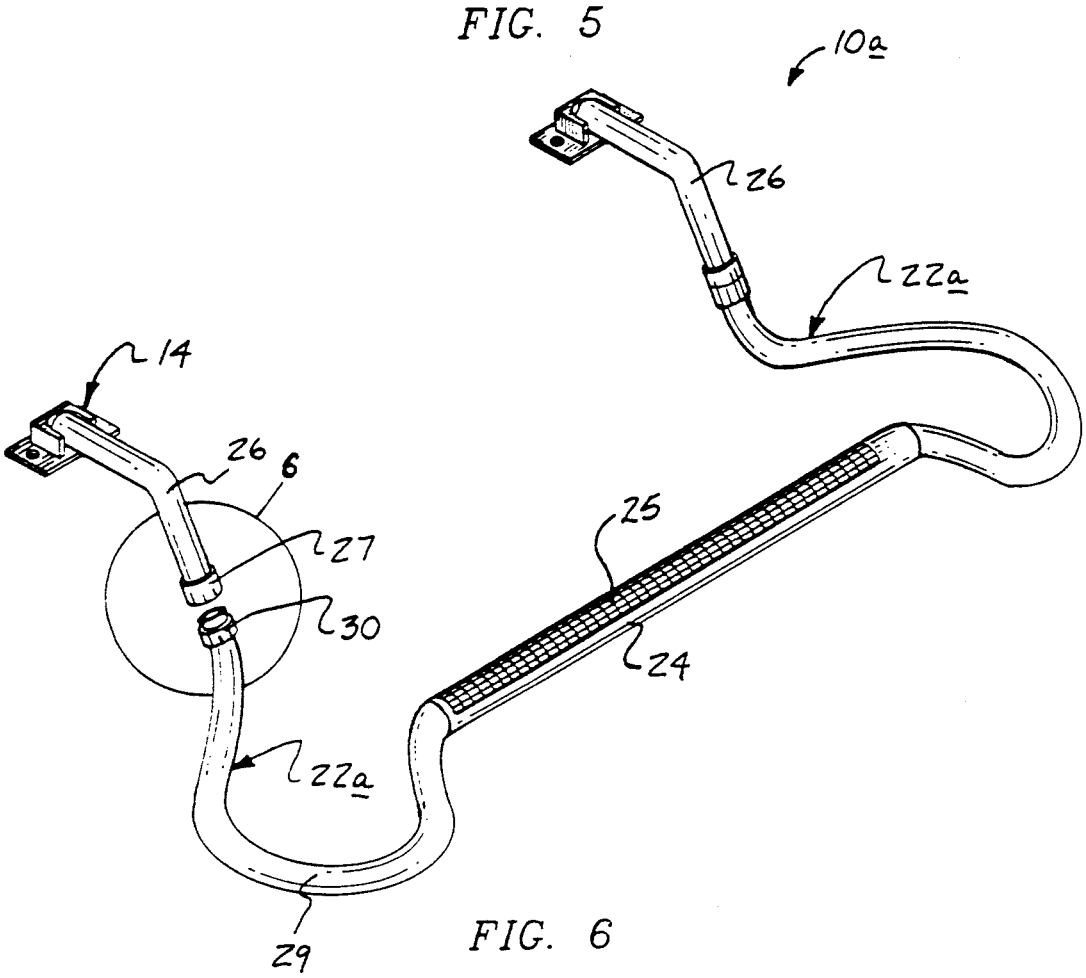
FIG. 5 is an isometric illustration of a modified support leg structure employed by the invention.
Figure 6:
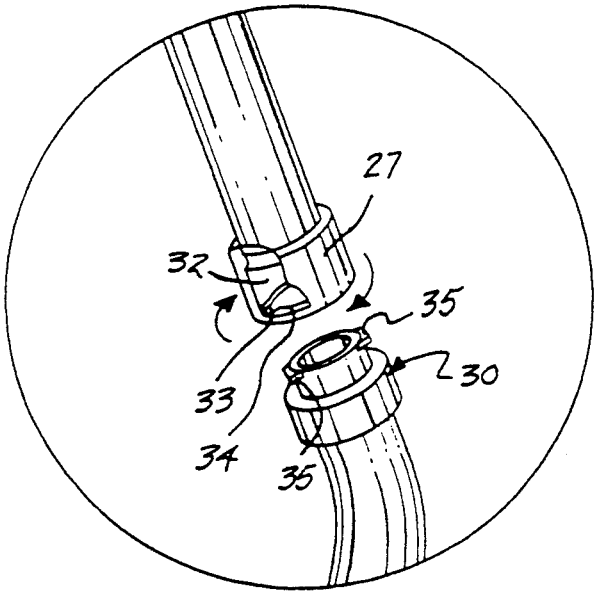
FIG. 6 is an enlarged isometric illustration of section 6 as set forth in FIG. 5.

The FIG. 5 indicates a modified bar structure 10*a*, having a first leg 26 to include the first end 23 mounted within a respective anchor bracket 14. The first leg includes a second end coupling 27 rotatably mounted to receive a second leg 29, and more specifically, the second leg first end coupling 30. The first end coupling 30 includes a plurality of projecting spaced lock plates 35 to be received within spaced slots 33 of the coupling socket 32 having the space slots 33. Upon rotation of the second end coupling 27, the lock plates 35 are mounted upon the flange 34 of an annular configuration. In this manner, the modified support leg structure 22*a* is accordingly formed of the first and second legs 26 and 29 respectively. In this manner, the modified support legs are disassembled for removal of the exercise bar structure 24 relative to the associated swimming pool 11.

Figure 7:
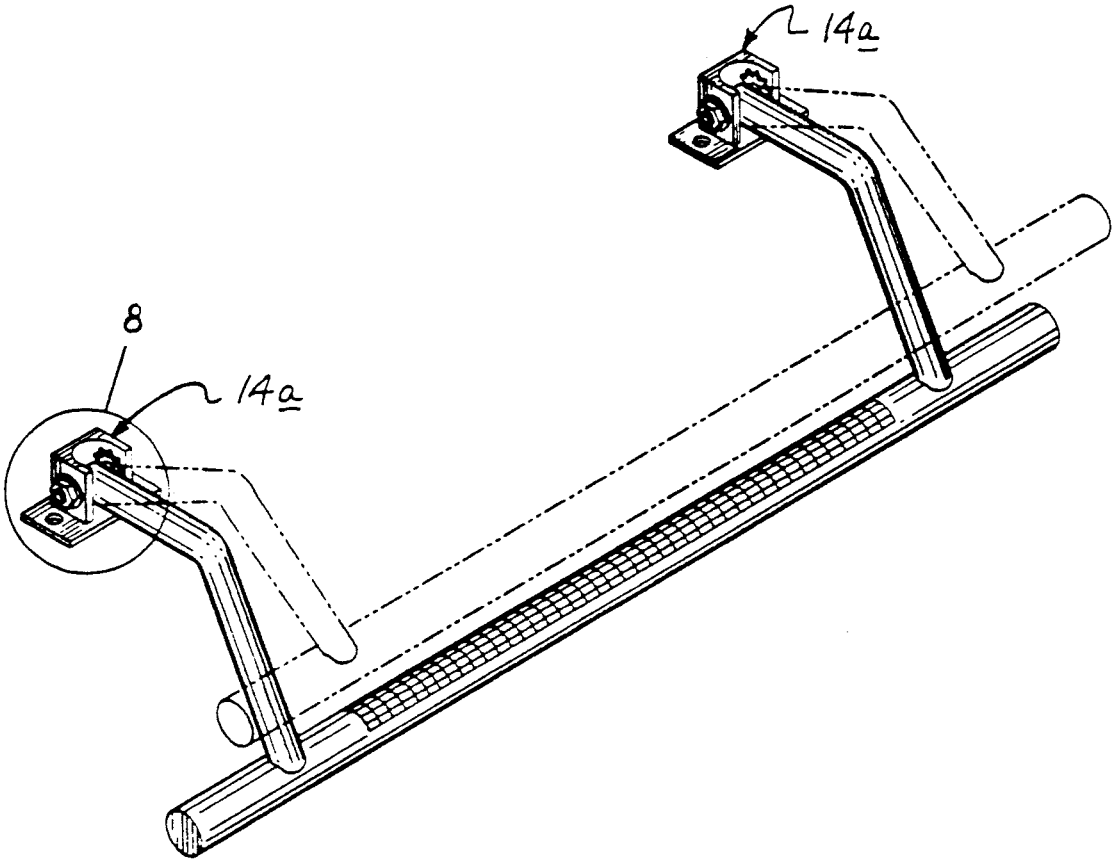
FIG. 7 is an isometric illustration of a modified support bracket structure utilized by the invention.
Figure 8:
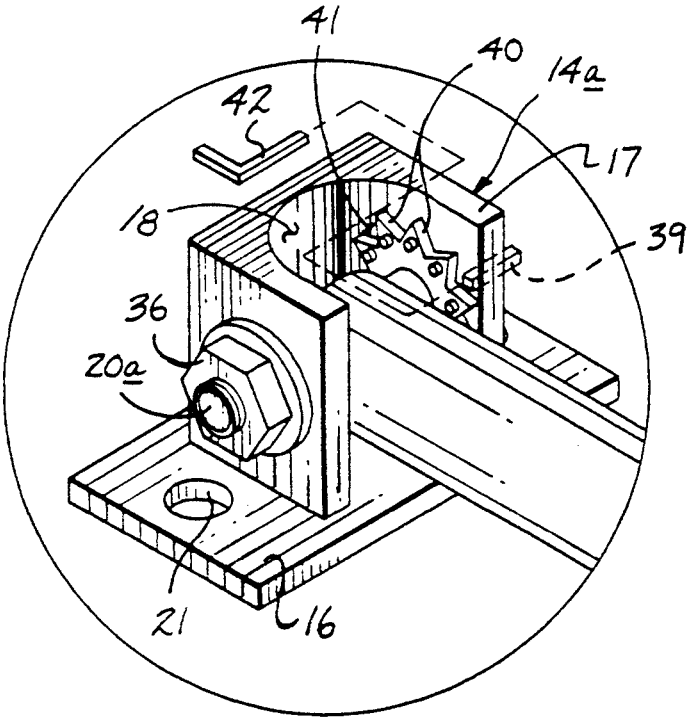
FIG. 8 is an enlarged isometric illustration of section 8 as set forth in FIG. 7.

The FIGS. 7 and 8 indicate the use of modified anchor brackets 14*a*, having each a modified mounting bar 20*a* directed through each boss receiving cavity 18. Fastener 36 is mounted to each end of the modified mounting bar 20*a* exteriorly of the cavity 18. A star lock wheel 37 is fixedly mounted to the modified mounting bar 20*a* utilizing splined interconnection, adhesives, or other mechanical techniques. The star lock wheel 37 is mounted in adjacency to an interior wall surface of the cavity 18 within the cavity 18 above the base plate 16. The star lock wheel 37 is formed of a series of spaced radial projections 40, each having a star wheel lug 38 mounted thereon. The interior wall of the cavity 18 includes a lock bore 39. With the boss 17 formed of a ferrous material, a magnetic lock rod 42 of an L-shaped configuration is arranged for projection through the lock bore 39 between adjacent projections 40 within a projection gap 41 for simultaneous abutment between adjacent projections, as well as engagement with one of the lock wheel lugs 38, as the rod is thusly positioned between an associated lug 38 and the mounting bar 20*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A swimming pool ballet bar, comprising, a plurality of anchor brackets;

each anchor bracket having a base plate;

a U-shaped support boss mounted to the base plate;

a plurality of support legs, with each of said support legs having a first end, each support leg mounted to one of the anchor brackets, with the support legs including a rigid exercise bar extending therebetween spaced from each said first end, with each said first end pivotally mounted within the U-shaped support boss;

each of the support legs include a first leg and a second leg, the first leg having the first end thereon, the first leg including a second end coupling spaced from the first end, and each second leg having a first end coupling arranged for reception within the second end coupling, and each second leg having a second leg second end, and each second leg second end fixedly mounted to the exercise bar;

the second end coupling includes a rotatable socket, the rotatable socket having spaced slots and an annular flange extending between the spaced slots, and the second leg first end coupling having a plurality of projecting spaced lock plates arranged for reception within the spaced slots, whereupon the projection of the lock plates within the spaced slots permits rotation of the second end coupling to position the lock plates onto the annular flange; and the U-shaped support boss has a boss receiving cavity receiving the first end therein, and each boss receiving cavity including a mounting bar, with the mounting bar pivotally mounting the first leg thereon, the cavity including a cavity interior wall, and the mounting bar having a star lock wheel fixedly mounted thereon oriented between the first leg first end and the cavity interior wall, the star lock wheel having spaced radial projections, with adjacent spaced radial projections having a gap therebetween, with the cavity interior wall including a lock bore arranged for orientation within the gap, and the boss formed of a ferrous material, with the L-shaped magnetic lock rod arranged for reception through the lock bore, and each of the radial projections having a lock lug thereon, with the L-shaped lock rod arranged for simultaneous projections through the lock bore and between one of the lugs and the mounting bar to selectively lock the first leg in a predetermined orientation relative to a respective anchor bracket.

* * * * *